United States Patent [19]

Reynolds et al.

[11] 3,950,803

[45] Apr. 20, 1976

[54] BOAT STANCHION

[76] Inventors: Clarke Reynolds, 535 Hillary Drive, Tiburon, Calif. 94920; Richard J. Quigley, 25538 Adobe Lane, Los Altos Hills, Calif. 94022

[22] Filed: Jan. 20, 1975

[21] Appl. No.: 542,161

[52] U.S. Cl. ..... 9/1 D; 105/380; 256/17; 256/50; 256/59; 425/392; 428/392

[51] Int. Cl.[2] ..... E04H 17/20

[58] Field of Search ..... 9/1 C, 1 D; 114/75; 105/380, 504; 119/147, 148; 256/19, 47, 50, 59; 280/179 A, 179 B, 143; 296/43, 71; 428/392; 425/392

[56] References Cited

UNITED STATES PATENTS

| | | | |
|---|---|---|---|
| 3,183,143 | 5/1965 | Harris | 428/392 |
| 3,671,384 | 6/1972 | Baer et al. | 428/392 |
| 3,700,213 | 10/1972 | Blease et al. | 256/59 |

FOREIGN PATENTS OR APPLICATIONS

| | | | |
|---|---|---|---|
| 1,160,275 | 8/1969 | United Kingdom | 256/59 |

*Primary Examiner*—Trygve M. Blix
*Assistant Examiner*—Charles E. Frankfort
*Attorney, Agent, or Firm*—Lowhurst & Aine

[57] ABSTRACT

A boat stanchion is formed of a single, continuous strand of fiberglass and thermosetting resin. The fiberglass strand is wound into a loop having a multiplicity of turns and the loop is then flattened to form a substantially straight bundle of overlapping strand sections. The strand bundle is placed in a mold with thermosetting resin. One half of the mold includes a pair of pointed rods which separate the strand sections when the two mold halfs are brought together to form two holes. The partial loop of overlapping strand sections at one end of the bundle encompasses one of the holes and approximately one half of the overlapping strand sections at approximately a mid-point of the bundle are positioned on one side of the other hole and the remainder thereof are positioned on the other side of that hole.

3 Claims, 5 Drawing Figures

BOAT STANCHION

BACKGROUND OF THE INVENTION

1. Field of the Invention

This invention relates generally to a boat stanchion and to a method of fabricating such a stanchion, and more particularly to a boat stanchion formed of a single, continuous strand of fiberglass and thermosetting resin.

2. Prior Art

Stanchions are employed in small and medium size boats at spaced intervals around the periphery of the deck for supporting one or more lifelines which are equivalent to a railing in larger boats. Such stanchions are supported in an upright position and are generally provided with one or more holes for receiving such lifelines. The primary purpose of such stanchions and the lifelines they support is to assist an occupant of the boat to maintain his stability and to prevent such an occupant from falling overboard.

Prior known boat stanchions have consisted of either bronze or aluminum cast members or stainless steel tubing. In those stanchions which consist of castings, the holes therein are formed during the casting process. In stainless steel tubing stanchions, however, such holes are formed by first drilling through the tubing and placing a perforated insert, such as a holloe rivet, therein.

It can be appreciated that that portion of the above described boat stanchions which is perforated constitutes a weakening in the member. Forces are often imposed on the boat stanchion via the lifeline which it supports. Accordingly, such forces are imposed on the boat stanchion at its most weakened portion; namely, on the material which surrounds the hole through which the lifeline passes.

Because of this weakened portion, prior known boat stanchions will deform by bending or breaking at that point when sufficient force is applied thereto. If, for example, the boat stanchion is supporting two lifelines running parallel to one another and one's weight is thrown against the top lifeline or against the upper end of the stanchion with sufficient force to deform or break that portion which surrounds the hole through which the lower lifeline passes, the stanchion will not recover to its initial shape when the load is removed. When this occurs, the strength of the material which has deformed or fractured reduces considerably and the stanchion is incapable thereafter of supporting the same amount of weight. If such failure of the boat stanchion occurs, however, when it is attempting to support a body, it will completely collapse with the result being that the body will fall overboard. Accordingly, it can be appreciated that such failure of boat stanchions is highly undesirable from the standpoint of safety.

It would appear that the obvious solution to the above mentioned problem is to stiffen the stanchion, such as by increasing its physical dimensions. Unfortunately, such stiffening of the stanchion produces another problem which is generally more serious than the above mentioned problem.

Such boat stanchions are secured to the deck of a boat by a base member and a plurality of screw fasteners. If the flexibility of the stanchion is reduced, its ability to absorb energy is also reduced and, therefore, a force on the stanchion will be transferred in its entirety to the base. That is, such stiffening of the stanchion will decrease its ability to absorb striking forces.

Accordingly, if a stanchion is stiffened sufficiently to increase its deforming resistance to a force of a certain magnitude, that same force will, under such stiffened conditions of the stanchion, cause damage to its base. Most likely under such conditions, the base will break and release the stanchion, or the screw fasteners will be torn from the decking.

Because of the adverse environmental conditions, such stanchions have been fabricated in the past from materials such as bronze, aluminum and stainless steel. Generally, the cost of fabricating stanchions of such materials is relatively high. Furthermore, it is desirable in most boats, and particularly sail boats, to lower the center of gravity by decreasing the weight above the deck. Stanchions, particularly those formed of bronze, are relatively heavy.

SUMMARY OF THE INVENTION

Accordingly, it is a primary object of the present invention to provide a boat stanchion which is capable of absorbing relatively great lateral forces and to provide a method of making such a boat stanchion.

Another object of the present invention is to provide a boat stanchion which is capable of absorbing the energy of a lateral force directed thereagainst and to provide a method of fabricating such a stanchion.

Still another object of the present invention is to provide a boat stanchion which is considerably less costly than prior known boat stanchions to fabricate.

Another object of the present invention is to provide a boat stanchion which is considerably lighter in weight than prior known boat stanchions.

These and other objects of the present invention are attained by a boat stanchion which is fabricated of a continuous strand of fiberglass extending a multiplicity of times between two extremes which define the ends of the stanchion. The continuous strand of fiberglass forms a partial loop at one of those ends, which loop encompasses one of the holes for receiving a lifeline. Approximately one half of the overlapping portions of the strand are positioned on one side of the second hole and the remainder thereof are positioned on the other side of the second hole. A quantity of hardened resin is disposed between and around the overlapping continuous strand and is formed around the above mentioned holes.

Generally the above described boat stanchion is fabricated by first winding a continuous strand of fiberglass into a loop having a multiplicity of turns, then flattening the loop to form a substantially straight bundle of overlapping strand sections, then separating approximately one half of the overlapping sections from the remaining sections at one location along the length of the bundle which corresponds to a hole therein for receiving a lifeline, then covering only the overlapping sections with resin, and then hardening the resin around the overlapping sections to form an elongated member with such a hole at that location.

The invention, however, as well as other objects, features and advantages thereof will be more fully realized and understood from the following detailed description, when taken in conjunction with the accompanying drawing, wherein:

DETAILED DESCRIPTION OF THE PREFERRED EMBODIMENTS

Figure 1:
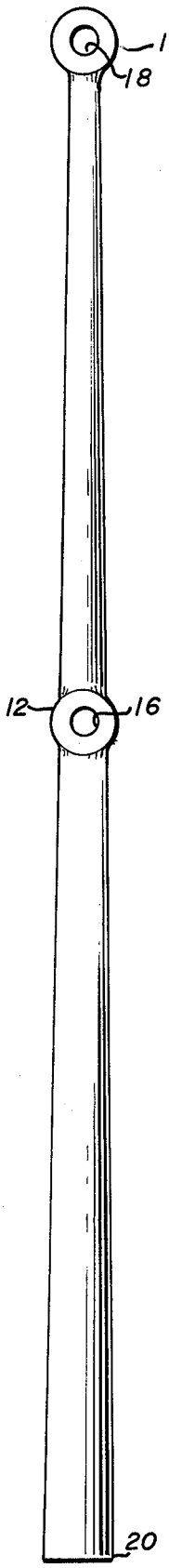
FIG. 1 is a front elevational view of a boat stanchion constructed in accordance with the principles of the present invention.
Figure 2:
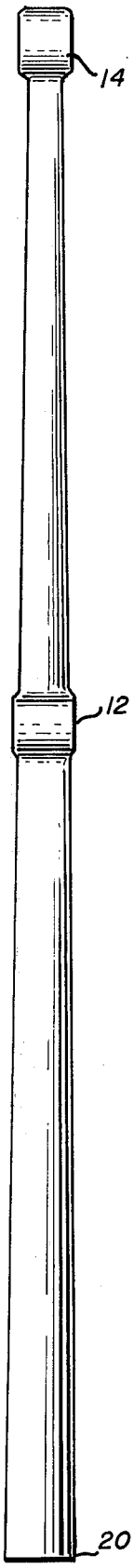
FIG. 2 is a side elevational view of the boat stanchion illustrated in FIG. 1.

With reference to FIGS. 1 and 2, there is shown a boat stanchion which is constructed in accordance with the principles of the present invention. The boat stanchion of the present invention is an elongated member 10 formed of a single, continuous strand of fiberglass and thermosetting resin. The stanchion is formed with a boss 12 at approximately a mid-point thereof and a boss 14 at one end thereof. The bosses 12 and 14 are provided with holes 16 and 18, respectively, therethrough for receiving respective lifelines. As shown in the drawing, the elongated member 10 is tapered from a lower end 20 thereof to the boss 14 at its other end. In a constructed embodiment of the present invention, approximately 70 percent of the volume of the elongated member 10 consisted of a single, continuous strand of fiberglass wound from one end to the other end thereof and 30 percent thermosetting resin impregnated in the fiberglass strand and disposed between and around the overlapping portions thereof and formed around the holes 16 and 18.

Figure 3:
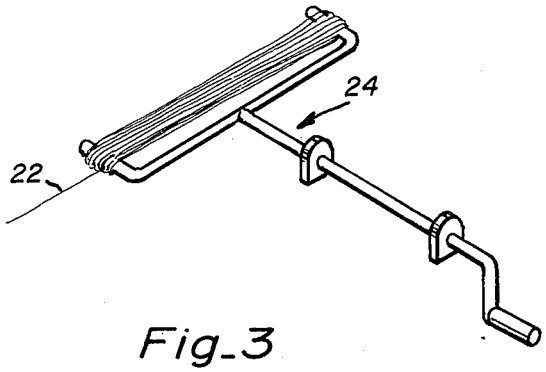
FIG. 3 is a view in perspective of a mechanism employed in performing one step of the method of fabricating the boat stanchion of the present invention.

Such a continuous strand of fiberglass is designated with the reference numeral 22 in FIG. 3. The fiberglass strand 22 is first wound on a loom, generally designated with the reference numeral 24, to form a loop bundle having a length equal to the desired length of the stanchion. After the fiberglass strand 22 has been wound with a sufficient number of turns, it is flattened and placed with thermosetting resin in a mold, such as that illustrated in FIGS. 4 and 5.

Figure 4:
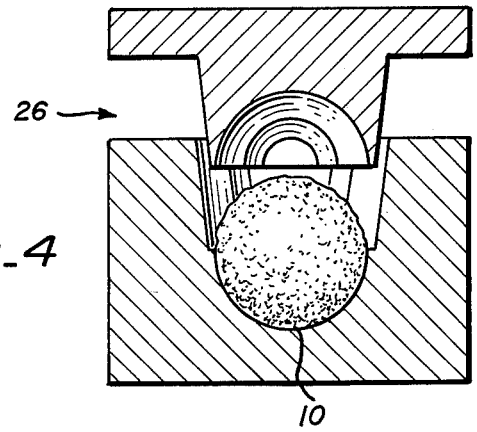
FIGS. 4 and 5 are sectional views of a mold employed in fabricating the boat stanchion of the present invention.
Figure 5:
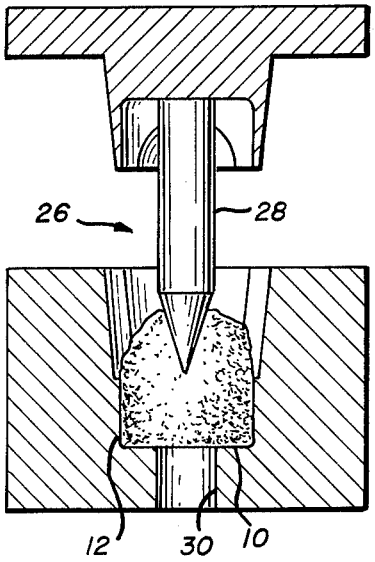

FIGS. 4 and 5 are sectional views of a compression mold employed in fabricating the boat stanchion of the present invention and for performing some of the steps of such fabrication. As shown in FIG. 4, the mold which is generally designated with the reference numeral 26, is provided with appropriate cavities for receiving the flattened bundle of the fiberglass strand 22 and thermosetting resin therein. FIG. 5 is a sectional view of the mold at a location corresponding to the boss 12. As shown therein, the mold 26 is provided with a sharply pointed rod 28 which is disposed for separating overlapping sections of the fiberglass bundle as one mold half is brought into engagement with the other mold half. An aperture 30 is provided in the mold 26 for receiving the rod 28 therethrough. A similar sharply pointed rod and aperture are provided for forming the hole 18 in the boss 14.

Accordingly, the boat stanchion of the present invention is formed by first winding the continuous strand of fiberglass 22 into a loop having a multiplicity of turns, then flattening the loop to form a substantially straight bundle of overlapping strand sections, and then placing the flattened loop in a mold, such as that illustrated in FIGS. 4 and 5. Thermosetting resin is also inserted into the mold and the two mold halves are brought into engagement with one another. When the two mold halves are brought into engagement with one another, the overlapping strand sections are separated by the sharply pointed rods. Thereafter, the thermosetting resin is permitted to harden, thereby forming an elongated member having holes 16 and 18 therein.

The cost of fabricating the boat stanchion of the present invention is approximately one-half of the cost of fabricating prior known boat stanchions. Furthermore, the weight of the boat stanchion of the present invention is approximately two-thirds less than that of a boat stanchion formed of bronze and approximately one-third less than that of a boat stanchion formed of stainless steel. The boat stanchion of the present invention is capable of withstanding lateral forces, particularly those which are directed thereagainst by a lifeline, because of the location of fiberglass strands around the lateral portions of each of the holes 16 and 18 therein. Furthermore, the boat stanchion of the present invention is capable of absorbing the energy of a striking force to a much greater degree than that of prior known boat stanchions.

The Invention Claimed Is:

1. A boat stanchion having a first hole between the ends thereof and a second hole in one end thereof, comprising a. a continuous strand of fiberglass extending a multiplicity of times between two extremes which define the ends of the stanchion and forming a partial loop at one of said ends, which loop encompasses the second hole, with approximately one half of the overlapping portions of said strand positioned on one side of the first hole and the remainder thereof positioned on the other side of the first hole, and b. a quantity of hardened resin disposed between and around the overlapping continuous strand and formed around the first and second holes.

2. The boat stanchion of claim 1, wherein the volumetric ratio of said strand of fiberglass to said resin is approximately 7 to 3.

3. A boat stanchion having at least one opening at an end thereof for holding a life line and comprising:

a continuous strand of fiberglass extending a multiplicity of times between the two extremes defining the ends of the stanchion and forming a partial loop at one of said ends, which loop encompasses said opening; and a quantity of hardened resin disposed between and around the overlapped continuous strand and formed around said opening.

* * * * *